US009920759B2

(12) United States Patent
Sung et al.

(10) Patent No.: US 9,920,759 B2
(45) Date of Patent: Mar. 20, 2018

(54) SCROLL COMPRESSOR WITH BACK PRESSURE DEVICE

(71) Applicant: LG ELECTRONICS INC., Seoul (KR)

(72) Inventors: Sanghun Sung, Seoul (KR); Jaesang Lee, Seoul (KR); Kitae Jang, Seoul (KR); Inho Won, Seoul (KR); Byeongchul Lee, Seoul (KR)

( * ) Notice: Subject to any disclaimer, the term of this patent is extended or adjusted under 35 U.S.C. 154(b) by 395 days.

(21) Appl. No.: 14/590,229

(22) Filed: Jan. 6, 2015

(65) Prior Publication Data

US 2015/0192121 A1 Jul. 9, 2015

(30) Foreign Application Priority Data

Jan. 6, 2014 (KR) ..... 10-2014-0001433

(51) Int. Cl.

| | |
|---|---|
| ***F04C 18/02*** | (2006.01) |
| ***F04C 28/26*** | (2006.01) |
| ***F04C 27/00*** | (2006.01) |
| ***F04C 29/12*** | (2006.01) |
| ***F04C 23/00*** | (2006.01) |

(52) U.S. Cl.

CPC ..... *F04C 18/0215* (2013.01); *F04C 18/0261* (2013.01); *F04C 23/008* (2013.01); *F04C 29/126* (2013.01)

(58) Field of Classification Search

CPC ..... F04C 28/24; F04C 14/26; F04C 15/064; F04C 29/124

USPC ..... 418/14

See application file for complete search history.

(56) References Cited

U.S. PATENT DOCUMENTS

| | | | | |
|---|---|---|---|---|
| 5,156,539 | A | 10/1992 | Anderson et al. | 418/55.4 |
| RE35,216 | E | 4/1996 | Anderson et al. | 417/310 |
| 8,025,492 | B2 * | 9/2011 | Seibel | F04C 18/0215 418/55.1 |
| 2011/0206548 | A1 * | 8/2011 | Doepker | F04C 18/0215 418/55.2 |
| 2014/0134031 | A1 * | 5/2014 | Doepker | F04C 29/126 418/55.1 |
| 2014/0356211 | A1 * | 12/2014 | Stover | F04C 18/0215 418/55.5 |

(Continued)

FOREIGN PATENT DOCUMENTS

| | | | |
|---|---|---|---|
| KR | 10-2000-0037517 | A | 5/2007 |
| KR | 10-2012-7023733 | A | 6/2014 |

*Primary Examiner* — Mark Laurenzi
*Assistant Examiner* — Anthony Ayala Delgado
(74) *Attorney, Agent, or Firm* — KED & Associates LLP

(57) ABSTRACT

A scroll compressor is provided that may include a casing; a discharge cover fixed to an inner space of the casing, that divides the inner space of the case into a suction space and a discharge space; a main frame in the casing, and spaced from the discharge cover; an orbital scroll that performs an orbital motion on the main frame; a non-orbital scroll coupled to the main frame so as to be movable up and down with respect to the orbital scroll, that forms a suction chamber, an intermediate pressure chamber, and a discharge chamber together with the orbital scroll; and a back pressure plate provided between the discharge cover and the non-orbital scroll, that forms a back pressure chamber that communicates with the intermediate pressure chamber. With such a configuration, a bypass valve may be easily installed, and application of an overload minimized.

18 Claims, 7 Drawing Sheets

(56) References Cited

U.S. PATENT DOCUMENTS

2016/0025093 A1* 1/2016 Doepker ..... F04C 23/008
418/22

* cited by examiner

SCROLL COMPRESSOR WITH BACK PRESSURE DEVICE

CROSS-REFERENCE TO RELATED APPLICATION(S)

Pursuant to 35 U.S.C. § 119(a), this application claims priority to Korean Application No. 10-2014-0001433, filed in Korea on Jan. 6, 2014, the contents of which is incorporated by reference herein in its entirety.

BACKGROUND

1. Field

A scroll compressor is disclosed herein.

2. Background

A scroll compressor refers to a compressor that utilizes a first or orbital scroll having a spiral wrap, and a second or non-orbital scroll having a spiral wrap, the first scroll performing an orbital motion with respect to the second scroll. While the first scroll and the second scroll are engaged with each other in operation, a capacity of a pressure chamber formed therebetween may be reduced as the first scroll performs the orbital motion. Hence, a pressure of a fluid in the pressure chamber may be increased, and the fluid discharged from a discharge opening formed at a central portion of the second scroll.

The scroll compressor performs a suction process, a compression process, and a discharge process consecutively while the first scroll performs the orbital motion. Because of operational characteristics, the scroll compressor may not require a discharge valve and a suction valve in principle, and its structure may be simple with a small number of components, thus making it possible to perform a high speed rotation. Further, as a change in torque required for compression is small, and the suction and compression processes consecutively performed, the scroll compressor is known to create minimal noise and vibration.

For the scroll compressor, an occurrence of leakage of a refrigerant between the first scroll and the second scroll should be avoided or kept at a minimum, and lubricity (lubrication characteristic) should be enhanced therebetween. In order to prevent a compressed refrigerant from leaking between the first scroll and the second scroll, an end of a wrap portion or wrap should be adhered to a surface of a plate portion or plate. On the other hand, in order for the first scroll to smoothly perform an orbital motion with respect to the second scroll, resistance due to friction should be minimized. The relationship between prevention of refrigerant leakage and enhancement of lubricity is contradictory. That is, if the end of the wrap portion and the surface of the plate portion are adhered to each other with an excessive force, leakage may be prevented. However, in such a case, more friction between the parts or components may result, thereby increasing noise and abrasion. On the other hand, if the end of the wrap portion and the surface of the plate portion are adhered to each other with less than an adequate sealing force, the friction may be reduced, but a lowering of the sealing force may result in an increase in leakage.

In order to solve such problems, a back pressure chamber having an intermediate pressure between a discharge pressure and a suction pressure may be formed on or at a rear surface of the first scroll or the second scroll. That is, the first scroll and the second scroll may be adhered to each other with a proper force, by forming a back pressure chamber that communicates with a compression chamber having an intermediate pressure, among a plurality of compression chambers formed between the first scroll and the second scroll. With such a configuration, leakage of refrigerant may be prevented and lubricity enhanced.

The back pressure chamber may be positioned on a lower surface of the first scroll or an upper surface of the second scroll. In this case, the scroll compressor with such a back pressure chamber may be referred to as a 'lower back pressure type scroll compressor' or an 'upper back pressure type scroll compressor' for convenience. The structure of the lower back pressure type scroll compressor is simple, and bypass holes easily formed. However, as its back pressure chamber is positioned on the lower surface of the first scroll, a form and position of the back pressure chamber may change due to the orbital motion. This may cause the first scroll to tilt, resulting in the occurrence of vibration and noise. Further, an O-ring to prevent leakage of compressed refrigerant may be rapidly abraded. The structure of the upper back pressure type scroll compressor is complicated. However, as the back pressure chamber of the upper back pressure type scroll compressor is fixed in form and position, the probability of the second scroll tilting is low, and sealing for the back pressure chamber is excellent.

Korean Patent Application No. 10-2000-0037517, entitled "Method for Processing Bearing Housing And Scroll Machine having Bearing Housing," which corresponds to U.S. Pat. No. 5,156,539 and U.S. Reissue Pat. No. 35,216, all of which are hereby incorporated by reference, discloses an example of such an upper back pressure type scroll compressor. FIG. 1 is a partial cross-sectional view showing an example of an upper back pressure type scroll compressor. The scroll compressor 1 of FIG. 1 may include a first or orbital scroll 30 configured to perform an orbital motion on a main frame 20 fixedly-installed in a casing 10, and a second or non-orbital scroll 40 engaged with the first scroll 30 to create a plurality of compression chambers upon the orbital motion. A back pressure chamber (BP) may be formed at an upper portion of the second scroll 40, and a floating plate 60 to seal the back pressure chamber (BP) may be installed so as to be slidable up and down along an outer circumferential surface of a discharge passage 45. A discharge cover 22 may be installed at an upper surface of the floating plate 60, thereby dividing an inner space of the scroll compressor 1 into a suction space (S) and a discharge space (D). A lip seal (not shown) may be installed between the floating plate 60 and the back pressure chamber (BP), so that refrigerant may be prevented from leaking from the back pressure chamber (BP).

The back pressure chamber (BP) may communicate with one of the plurality of compression chambers, and may be at a receiving end of an intermediate pressure from the plurality of compression chambers. With such a configuration, pressure may be applied upward to the floating plate 60, and pressure may also be applied downward to the second scroll 40. If the floating plate 60 moves upward due to the pressure of the back pressure chamber (BP), the discharge space (D) may be sealed as an end of the floating plate 60 contacts the discharge cover 22. In this case, the second scroll 40 may move downward to be adhered to the first scroll 30. With such a configuration, a gap between the second scroll 40 and the first scroll 30 may be effectively sealed.

However, in the case of the above upper back pressure type scroll compressor, as an upper surface of the non-orbital scroll 40 is blocked by the back pressure chamber, bypass holes cannot be formed. To solve such a problem, Korean Patent Application No. 10-2012-7023733, entitled "Compressor having valve assembly", discloses an example of such an upper back pressure type scroll compressor. As shown in FIG. 2, a hub member 76 is positioned at a central portion of back pressure chamber (BP), and is penetratingly-formed at the back pressure chamber (BP) in upper and lower directions. A valve assembly 28 is provided below the hub member 76. As the valve assembly is moved in the up/down direction in the hub member 76, bypass holes 90 and 92 formed on an upper surface of the non-orbital scroll are open and closed.

In the conventional art, an upper back pressure type scroll compressor is provided with the bypass holes to prevent an overload. However, due to the hub member arranged in the back pressure chamber, a position of the bypass holes cannot be arbitrarily set. That is, as the back pressure chamber must be arranged at a predetermined position with a predetermined size in order to obtain a sufficient back pressure, a size of the hub member is restricted. Thus, a position of the bypass holes is also restricted due to a load of the hub member.

Further, a floating plate should seal the back pressure chamber by contacting an inner surface of the back pressure chamber of the non-orbital scroll, and an outer circumferential surface of the hub member. In this case, a sealing function of the floating plate may be lowered due to a machining tolerance and a coupling tolerance of the hub member.

Further, as the floating plate and the hub member are separated from each other, a machining tolerance and an assembly tolerance occur. This may cause a difficulty in sealing a gap between the back pressure chamber and a discharge opening, and may increase production costs due to an increased number of assembly processes.

BRIEF DESCRIPTION OF THE DRAWINGS

Embodiments will be described in detail with reference to the following drawings in which like reference numerals refer to like elements, and wherein.

DETAILED DESCRIPTION

Figure 1:
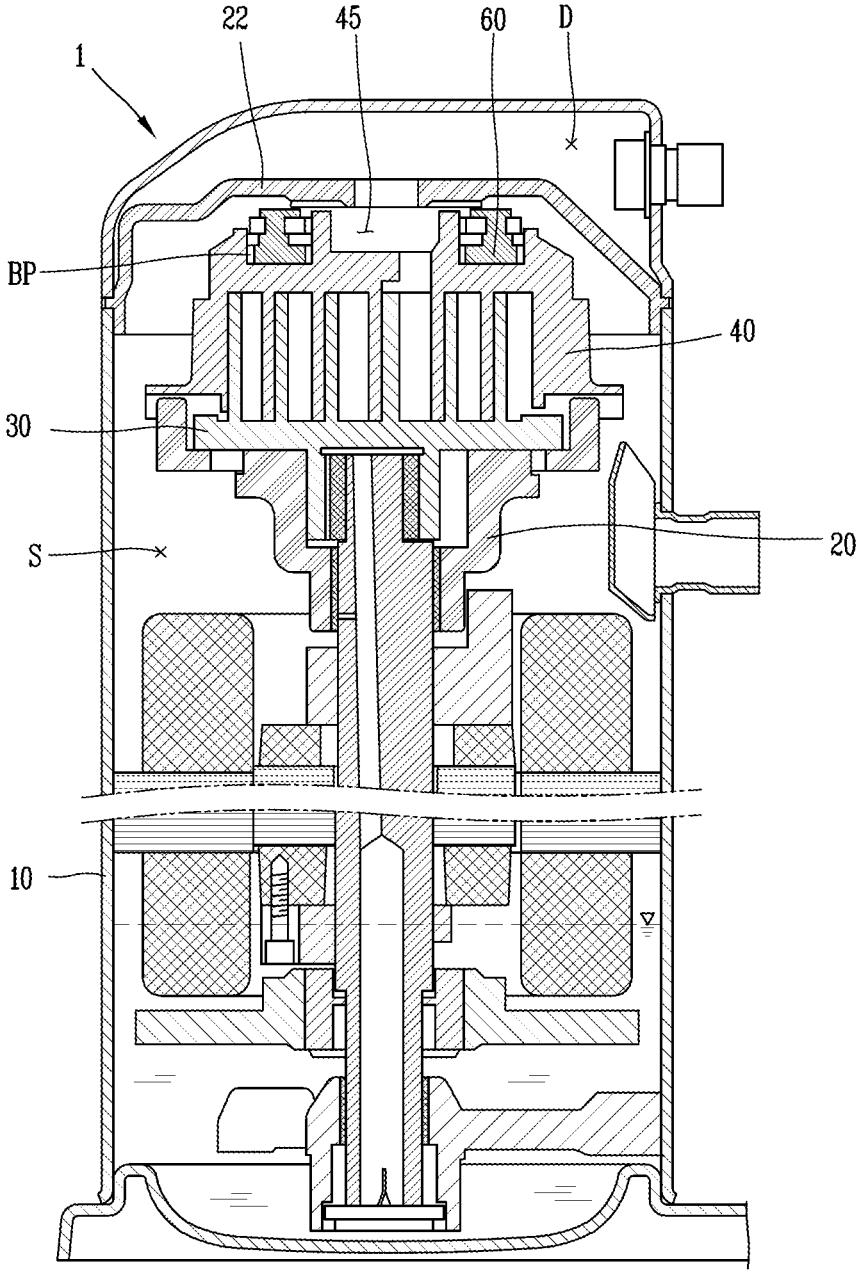
FIG. 1 CONVENTIONAL ART
FIG. 1 is a cross-sectional view of an upper back pressure type scroll compressor in accordance with conventional art.
Figure 2:
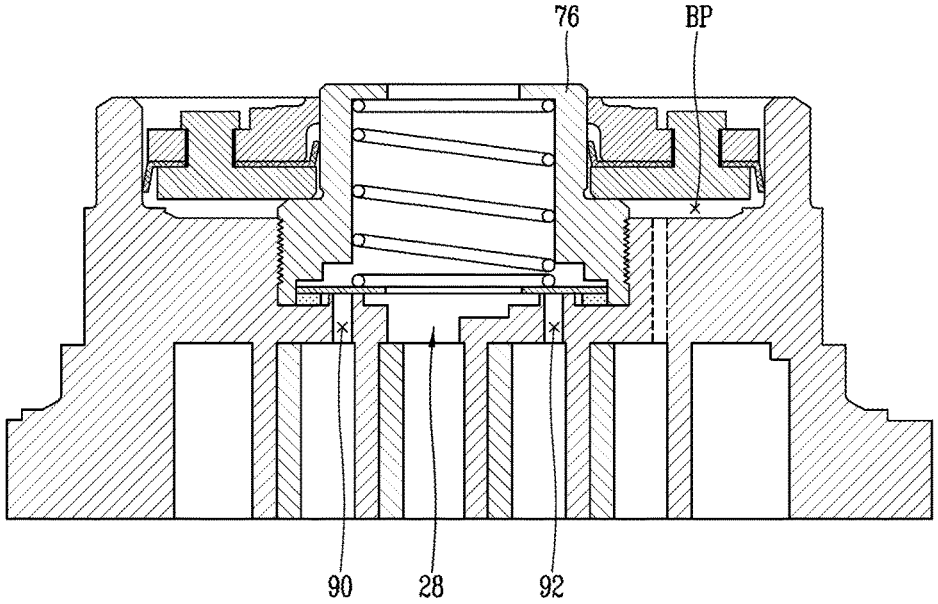
FIG. 2 CONVENTIONAL ART
FIG. 2 is a cross-sectional view of another upper back pressure type scroll compressor in accordance with conventional art.

Description will now be given in detail of embodiments, with reference to the accompanying drawings. Where possible, like reference numerals have been used to indicate like elements, and repetitive disclosure has been omitted.

Hereinafter, an upper back pressure type scroll compressor according to an embodiment will be explained in more detail with reference to the attached drawings.

Figure 3:
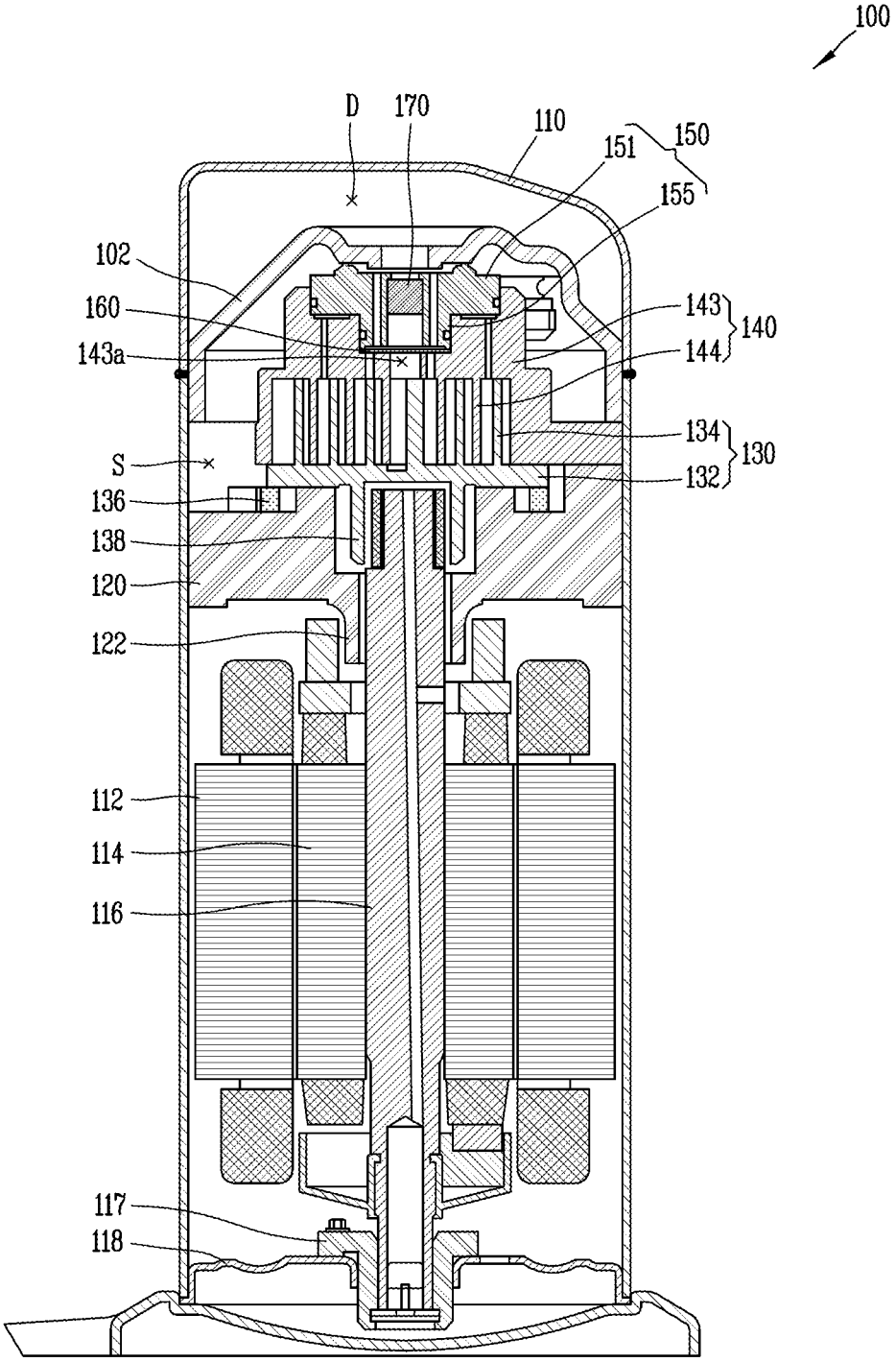
FIG. 3 is a cross-sectional view of an upper back pressure type scroll compressor having a back pressure discharge according to an embodiment.
Figure 4:
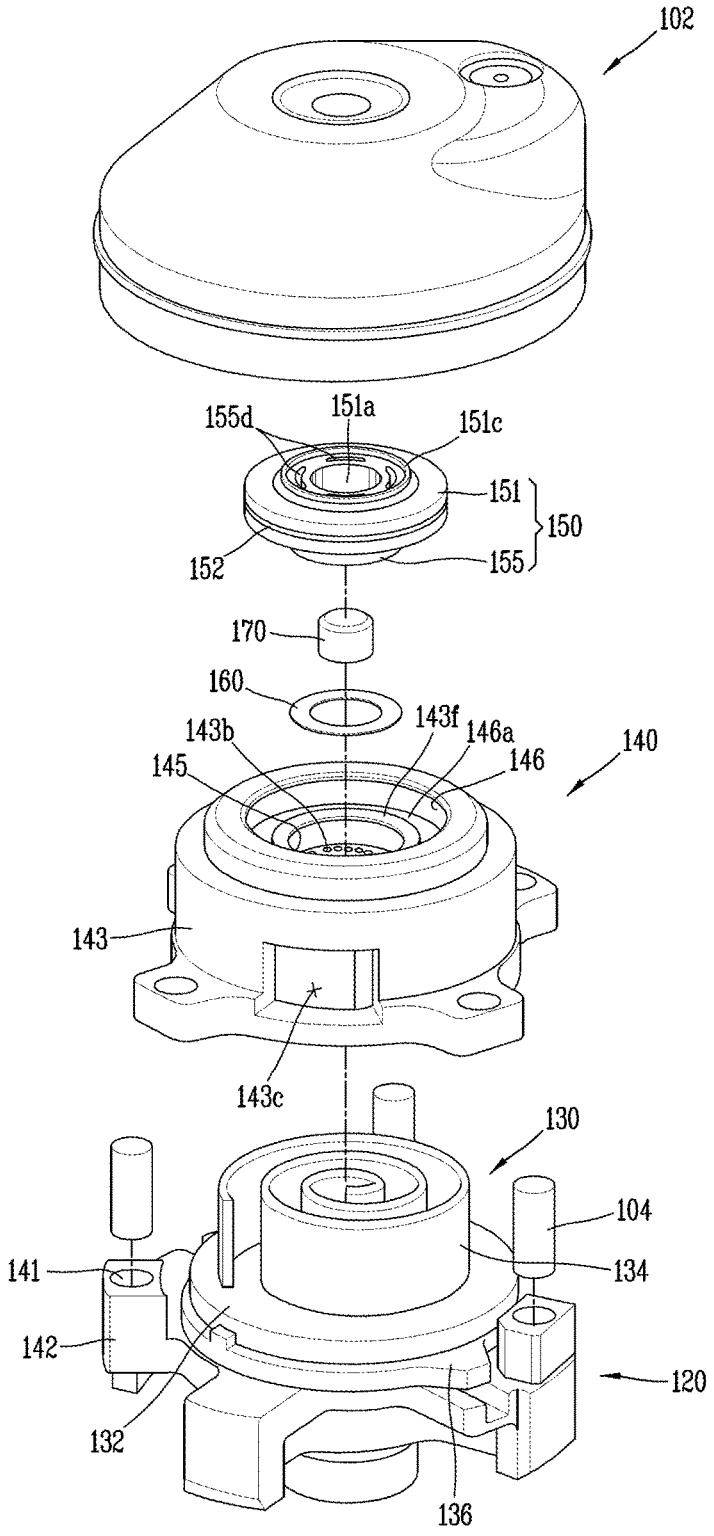
FIG. 4 is a disassembled perspective view illustrating a back pressure plate of the upper back pressure type scroll compressor of FIG. 3.
Figure 5:
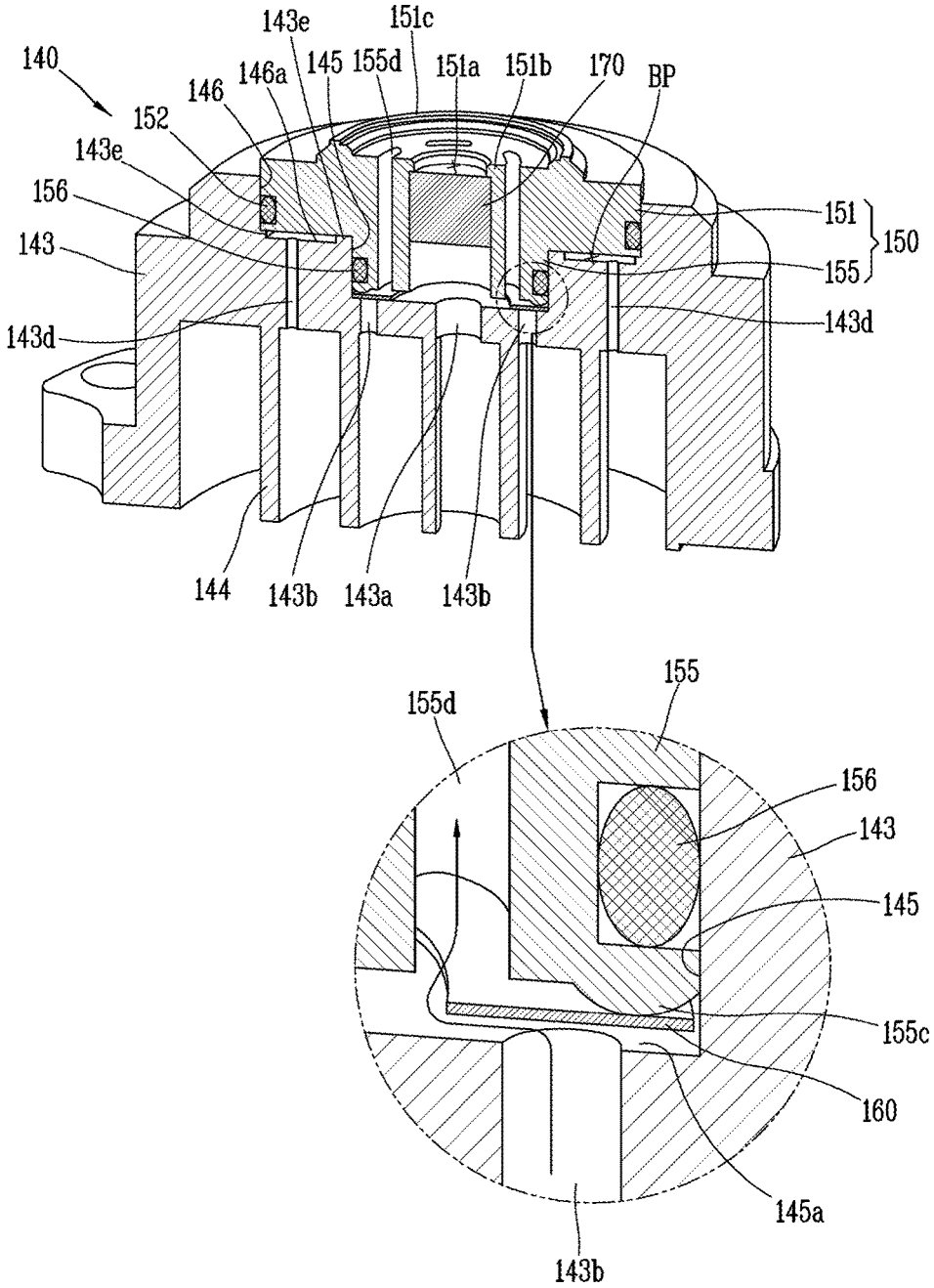
FIG. 5 is a perspective view illustrating a coupled state between a non-orbital scroll and a back pressure plate of the upper back pressure type scroll compressor of FIG. 3.
Figure 6:
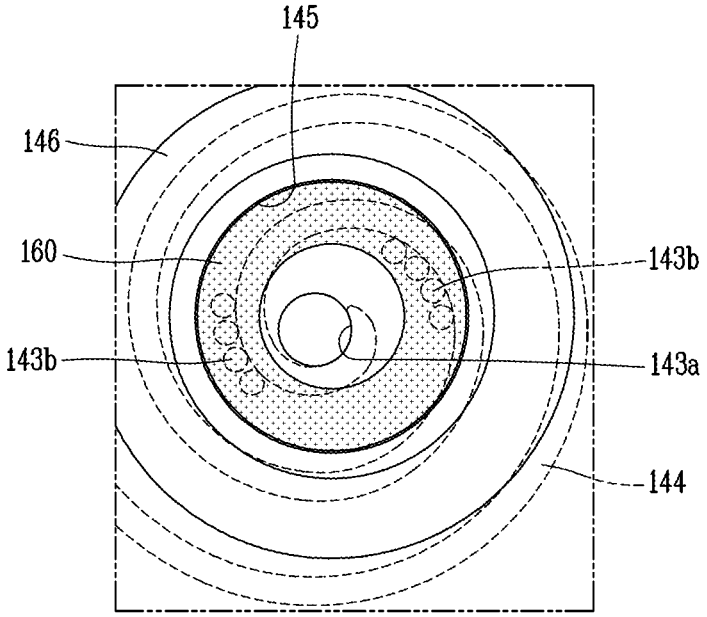
FIG. 6 is a planar view illustrating bypass holes and a bypass valve of FIG. 5.

FIG. 3 is a cross-sectional view of an upper back pressure type scroll compressor having a back pressure discharge according to an embodiment. FIG. 4 is a disassembled perspective view illustrating a back pressure plate of the upper back pressure type scroll compressor of FIG. 3. FIG. 5 is a perspective view illustrating a coupled state between a non-orbital scroll and a back pressure plate of the upper back pressure type scroll compressor of FIG. 3 FIG. 6 is a planar view illustrating bypass holes and a bypass valve of FIG. 5.

Referring to FIGS. 3 and 5, scroll compressor 100 having a bypass according to an embodiment may include a casing 110 having therein a suction space (S) and a discharge space (D). An inner space of the casing 110 may be divided into the suction space (S) and the discharge space (D) by a discharge cover 102 installed at an upper side of the casing 110. An upper side of the discharge cover 102 may correspond to the discharge space (D), and a lower side of the discharge cover 102 may correspond to the suction space (S). A suction port (not shown) that communicates with the suction space (S), and a discharge port (not shown) that communicates with the discharge space (D) may be fixed to the casing 110, respectively, so that a refrigerant may be sucked into the casing 110 or discharged from the casing 110 therethrough.

A stator 112 and a rotor 114 may be provided below the suction space (S). The stator 112 may be fixed to an inner wall surface of the casing 110 in a shrink fit manner, for example, and a rotational shaft 116 may be inserted into a central portion of the rotor 114. The rotational shaft 116 may be rotated by power supplied from outside of the scroll compressor 100.

A lower side of the rotational shaft 116 may be rotatably supported by an auxiliary bearing 117 installed at a lower side of the casing 110. The auxiliary bearing 117 may be supported by a lower frame 118 fixed to an inner surface of the casing 110, to thereby stably support the rotational shaft 116.

The lower frame 118 may be fixed to an inner wall surface of the casing 110 by, for example, welding, and a bottom surface of the casing 110 may be used as an oil storage space. Oil stored in the oil storage space may be upwardly transferred by the rotational shaft 116, so as to be uniformly supplied to an inner space of the casing 110.

An upper end of the rotational shaft 116 may be rotatably supported by a main frame 120. The main frame 120 may be fixedly installed on an inner wall surface of the casing 110 together with the lower frame 118, and a main bearing portion or main bearing 122 that protrudes in a downward direction may be formed at a bottom surface of the main frame 120. The rotational shaft 116 may be inserted into the main bearing portion 122. An inner wall surface of the main bearing portion 122 may serve as a bearing surface and support the rotational shaft 116 to be smoothly rotated together with the aforementioned oil.

An orbital scroll 130 may be arranged on an upper surface of the main frame 120. The orbital scroll 130 may include a plate portion or plate 132 having an approximate disc shape, and an orbital wrap 134 formed at one or a first side surface of the plate portion 132 in a spiral shape. The orbital wrap 134 may form a compression chamber together with a non-orbital wrap 144 of a non-orbital scroll 140 discussed hereinbelow. The plate portion 132 of the orbital scroll 130 may perform an orbital motion in a state supported by an upper surface of the main frame 120. An Oldham's ring 136 may be installed between the plate portion 132 and the main frame 120, to prevent rotation of the orbital scroll 130. A boss portion or boss 138 that receives insertion therein the rotational shaft 116 may be formed at a bottom surface of the plate portion 132 of the orbital scroll 130. With such a configuration, a rotational force of the rotational shaft 116 may be used to make the orbital scroll 130 orbit.

The non-orbital scroll 140 engaged with the orbital scroll 130 may be arranged at an upper side of the orbital scroll 130. The non-orbital scroll 140 may be installed to be moveable in upward and downward directions with respect to the orbital scroll 130. More specifically, the non-orbital scroll 140 may be disposed on an upper surface of the main frame 120, in a state in which three guide pins 104 inserted into the main frame 120 are inserted into three guide holes 141 formed on an outer circumference of the non-orbital scroll 140.

The guide holes 141 may be formed at or in three pin supporting portions or supports 142 that protrude from an outer circumferential surface of a body portion or body of the non-orbital scroll 140, respectively. The number of the guide pins 104 or the pin supporting portions 142 may be arbitrarily set. Therefore, the number of the guide pins 104 or the pin supporting portions 142 is not limited to three.

An upper surface of the body portion of the non-orbital scroll 140 may be formed to have a disc shape, thereby forming a plate portion or plate 143. The non-orbital wrap 144 engaged with the orbital wrap 134 of the orbital scroll 130 may be formed at a lower part or portion of the plate portion 143.

The non-orbital wrap 144 may extend to have a predetermined spiral shape. A discharge opening 143*a*, through which a compressed refrigerant may be discharged, may be formed at an approximate central part or portion of the plate portion 143. A first ring-shaped wall 145, having a predetermined depth so as to accommodate therein the discharge opening 143*a* and bypass holes 143*b* discussed hereinbelow, may be formed at a periphery of the discharge opening 143*a*. With such a configuration, as a height of the discharge opening 143*a* and the bypass holes 143*b* is lowered, a dead volume may be reduced by the lowered height. Further, a guide portion or guide 155 of a back pressure plate 150, discussed hereinbelow, may be inserted into the first ring-shaped wall 145 in upper and lower directions, thereby enhancing a sealing effect between the discharge opening 143*a* and a back pressure chamber (BP).

A suction opening 143*c*, through which a refrigerant within the suction space (S) may be sucked, may be formed on a side surface of the non-orbital scroll 140. Accordingly, a refrigerant may be sucked into the suction opening 143*c* by an interaction between the non-orbital scroll 140 and the orbital wrap 134.

As discussed above, the non-orbital wrap 144 and the orbital wrap 134 form a plurality of compression chambers, and the compression chambers compress a refrigerant by having a reduced volume while orbiting toward the discharge opening 143*a*. Therefore, a compression chamber adjacent to the suction opening 143*c* may have a minimized pressure, and a compression chamber that communicates with the discharge opening 143*a* may have a maximized pressure. A compression chamber between the two compression chambers may have an intermediate pressure between a suction pressure of the suction opening 143*c* and a discharge pressure of the discharge opening 143*a*.

The intermediate pressure may be applied to the back pressure chamber (BP) hereinbelow, thereby pressing the non-orbital scroll 140 toward the orbital scroll 130. Therefore, at least one back pressure hole 143*d*, which may communicate with one region having an intermediate pressure and through which a refrigerant at an intermediate pressure may be discharged to the back pressure chamber (BP), may be formed at the plate portion 143 of the non-orbital scroll 140. An upper end of the back pressure hole 143*d* may be penetratingly-formed at an upper surface of the plate portion 143 between an outer side of the first ring-shaped wall 145 and an inner side of a second ring-shaped wall 146 of the non-orbital scroll 140 (hereinafter, referred to as "second upper surface 146*a*)". Back pressure chamber protrusions 143*e* may be formed on an inner side surface and an outer side surface of the second upper surface 146*a* which forms the back pressure chamber (BP), respectively, such that the back pressure chamber (BP) may be formed as the guide portion 155 of the back pressure plate 150 discussed hereinbelow spaced from an upper surface of the non-orbital scroll 140.

As shown in FIG. 6, the bypass holes 143*b*, which may be configured to prevent over-compression by bypassing a part or portion of a refrigerant to be compressed, may be formed at two sides of the discharge opening 143*a*, that is, sides closer to a discharge side than the back pressure holes 143*d*. The bypass holes 143*b* may be penetratingly-formed at the plate portion 143, and may extend up to an upper surface of the plate portion inside of the first ring-shaped wall 145 (hereinafter, referred to as a "first upper surface 145*a*"), from the compression chamber formed by the non-orbital wrap 144 and the orbital wrap 134.

A position of the bypass holes 143*b* may be differently set according to a drive condition. For example, the bypass holes 143*b* may be formed so as to communicate with a compression chamber having a pressure 1.5 times higher than a suction pressure. The bypass holes 143*b* may be formed to include a plurality of through holes along a path of the non-orbital wrap 144. The bypass holes 143*b* may be formed so as to communicate with two compression chambers formed inside and outside of the non-orbital wrap 144.

Figure 7:
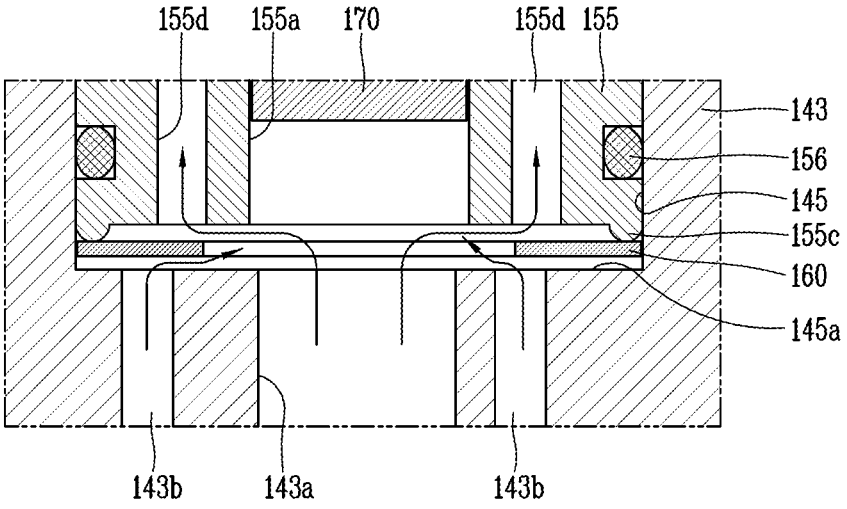
FIG. 7 is an enlarged, partial, cross-sectional view illustrating an opening/closing operation of a bypass valve of the upper back pressure type scroll compressor of FIG. 3 according to an embodiment.

As shown in FIG. 6, a bypass valve 160 may be formed in a ring shape having a diameter large enough to cover all of the bypass holes 143*b* when there is no external force applied thereto. Further, as shown in FIG. 7, the bypass valve 160 may be inserted into a valve space defined between the first upper surface 145*a* and a lower surface of the guide portion 155 of the back pressure plate 150, so as to be freely moveable up and down within a predetermined range. Alternatively, the bypass valve 160 may be inserted into a valve recess (not shown) having a ring shape and formed at a lower surface of the guide portion 155 of the back pressure plate 150.

The lower surface of the guide portion 155 may serve as a retainer to restrict an open degree of the bypass valve 160. However, as shown in FIGS. 5 and 7, a retainer protrusion 155*c* may be formed at the lower surface of the guide portion 155, so that an open degree of the bypass valve 160 may be restricted and an intermediate discharge opening 155*d* discussed hereinbelow may be open even in an open state of the bypass valve 160.

Figure 8:
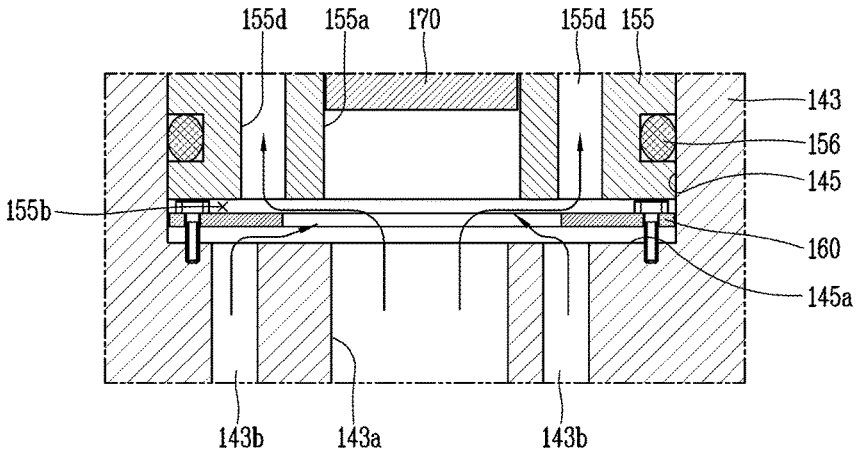
FIG. 8 is an enlarged cross-sectional view illustrating an opening/closing operation of a bypass valve according to another embodiment.

As shown in FIG. 8, the bypass valve 160 may be coupled to the non-orbital scroll 140 by, for example, a bolt or a rivet, to thus be inserted into a valve recess 155*b* of the back pressure plate 150. The back pressure plate 150 may be installed above the plate portion 143 of the non-orbital scroll 140, so as to be slidably movable in upper and lower directions.

The back pressure plate 150 may be provided with a back pressure portion 151 that forms the back pressure chamber (BP) by covering the second upper surface 146*a* of the non-orbital scroll 140. The guide portion 155, which may be configured to support the bypass valve 160 by being inserted into the first ring-shaped wall 145 of the non-orbital scroll 140, may be formed at a central part or portion of a lower surface of the back pressure portion 151.

The back pressure portion 151 may be formed in a ring shape having an outer diameter and an inner diameter, each diameter being large enough to cover the second upper surface 146*a*, that is, each diameter large being enough to be positioned on inner back pressure chamber protrusion 143*e* and outer back pressure chamber protrusion 143*e*. An outer circumferential surface of the back pressure portion 151 may be formed to contact an inner circumferential surface of the second ring-shaped wall 146 formed at an edge of an upper surface of the non-orbital scroll 143. A sealing groove (not shown) may be formed at one of an inner circumferential surface of the second ring-shaped wall 146, or an outer circumferential surface of the back pressure portion 151. In the drawings, the sealing groove is formed at an outer circumferential surface of the back pressure portion 151. A sealing member 152, such as an O-ring, may be inserted into the sealing groove.

A discharge pressure application hole 151*a*, which may communicate with a valve guide hole 155*a* of the guide portion 155 discussed hereinbelow, may be formed on an inner circumferential surface of the back pressure portion 151. The discharge pressure application hole 151*a* may always communicate with the discharge space (D). With such a configuration, when a refrigerant backflows to the discharge opening 143*a* from the discharge space (D), pressure applied to the discharge pressure application hole 151*a* becomes higher than a pressure of the discharge opening 143*a*. Thus, a check valve 170 discussed hereinbelow may move in a downward direction to close the discharge opening 143*a*. In contrast, when the pressure of the discharge opening 143*a* becomes higher than the pressure of the discharge space (D), the check valve 170 may move in an upward direction to allow a discharge process.

The check valve 170 may be formed in a cylindrical shape, and have a lower end portion or end large enough to completely cover the discharge opening 143*a*. Thus, when the check valve 170 contacts the plate portion 143 of the non-orbital scroll 140, the check valve 170 may block the discharge opening 143*a*. The check valve 170 may be supported by a compression coil spring.

A stepped portion 151*b*, which may be configured to support the check valve 170 so as to prevent an upper end of the check valve 170 from being separated from the valve guide hole 155*a* discussed hereinbelow, may be formed between the discharge pressure application hole 151*a* and the valve guide hole 155*a*. A sealing protrusion 151*c*, which may be configured to seal a gap between the discharge cover 102 and the back pressure portion 151 by contacting a lower surface of the discharge cover 102, may be formed on an upper surface of the back pressure portion 151 in a ring shape, for example.

The guide portion 155 may be formed in a cylindrical shape, with the valve guide hole 155*a* formed at a central part or portion thereof. An outer diameter of the guide portion 155 may be formed to be almost equal to an inner diameter of the first ring-shaped wall 145 in size, such that an outer circumferential surface of the guide portion 155 may slidably contact the first ring-shaped wall 145 of the non-orbital scroll 140. A sealing groove (not shown) may be formed at one of an outer circumferential surface of the guide portion 155 or an inner circumferential surface of the first ring-shaped wall 145. A sealing member 156, such as an O-ring, may be inserted into the sealing groove.

A retainer protrusion 155*c* may be formed at a lower surface of the guide portion 155. Alternatively, valve recess 155*b*, which may be configured to accommodate the bypass valve 160, may be formed with steps at an inner edge of the guide portion 155.

The intermediate discharge opening 155*d* may be penetratingly-formed in upper and lower directions, from a lower surface of the guide portion 155 to an upper surface of the back pressure portion 151. The intermediate discharge opening 155*d* may provide a flow passage along which a refrigerant discharged from the discharge opening 143*a* may flow to the discharge space (D). In the drawings, 4 intermediate discharge openings 155*d* are arranged in a radial direction. However, the number of the intermediate discharge openings 155*d* may be arbitrarily set.

Rather than the configuration in which the intermediate discharge opening 155*d* is formed to pass through a lower surface of the guide portion 155 and an upper surface of the back pressure portion 151, a communication hole that communicates with the intermediate discharge opening 155*d* may be formed at a central part or portion of an inner circumferential surface of the valve guide hole 155*a*. In both cases, a refrigerant passing through the discharge opening 143*a* may not be discharged to the intermediate discharge opening 155*d*, in a closed state of the check valve 170.

A valve recess (not shown), which may be configured to accommodate therein the bypass valve, may be formed at a first upper surface of the non-orbital scroll 140. In this case, a length of the bypass hole may be shortened, and thus, a dead volume occurring due to the bypass hole may be reduced.

An operation of the scroll compressor according to an embodiment will be discussed hereinbelow.

Once power is applied to the stator 112, the rotational shaft 116 may be rotated. The orbital scroll 130 fixed to an upper end of the rotational shaft 116 may perform an orbital motion with respect to the non-orbital scroll 140, as the rotational shaft 116 is rotated. As a result, a plurality of compression chambers formed between the non-orbital wrap 144 and the orbital wrap 134 may move toward the discharge opening 143*a*, thereby compressing a refrigerant.

If the compression chambers communicate with the back pressure holes 143*d* before a refrigerant reaches the discharge opening 143*a*, the refrigerant may be partially introduced into the back pressure holes 143*d*. Thus, an intermediate pressure may be applied to the back pressure chamber (BP) formed by the back pressure plate 150 and the non-orbital scroll 140. As a result, pressure may be applied to the non-orbital scroll 140 in a downward direction, and pressure may be applied to the back pressure plate 150 in an upward direction.

As the non-orbital scroll 140 is in a state not to be able to move in a downward direction due to contact with the plate portion 132 of the orbital scroll 130, the back pressure plate 150 is moved upward. The back pressure plate 150 may stop moving as the sealing protrusion 151*c* contacts a lower end of the discharge cover 102. Then, the back pressure plate 150 may prevent leakage between the orbital scroll 130 and the non-orbital scroll 140, as pressure of the back pressure chamber (BP) pushes the non-orbital scroll 140 toward the orbital scroll 130.

On the other hand, if the pressure of the discharge opening becomes higher than the pressure of the discharge space (D), the check valve 170 may be moved upward. As a result, a refrigerant of the discharge chamber may be discharged to the discharge guide hole 155*a*, and then, introduced into the intermediate discharge opening 155*d*. Finally, the refrigerant may be discharged to the discharge space (D). If the scroll compressor is stopped, or if pressure of the discharge space (D) is temporarily increased, the check valve 170 may be moved downward to block the discharge opening. This may prevent rotation of the non-orbital scroll 140 in a reverse direction due to backflow of refrigerant.

As the valve recess 155*b* communicates with a discharge passage due to the intermediate discharge opening 155*d*, a discharge pressure may be applied to the valve recess 155*b*. A pressure of an intermediate pressure chamber may be applied to a bottom surface of the bypass valve 160. In a normal condition, the bypass valve 160 may maintain a closed state of the bypass holes 143*b*, as the discharge pressure is higher than an intermediate pressure.

Figure 9:
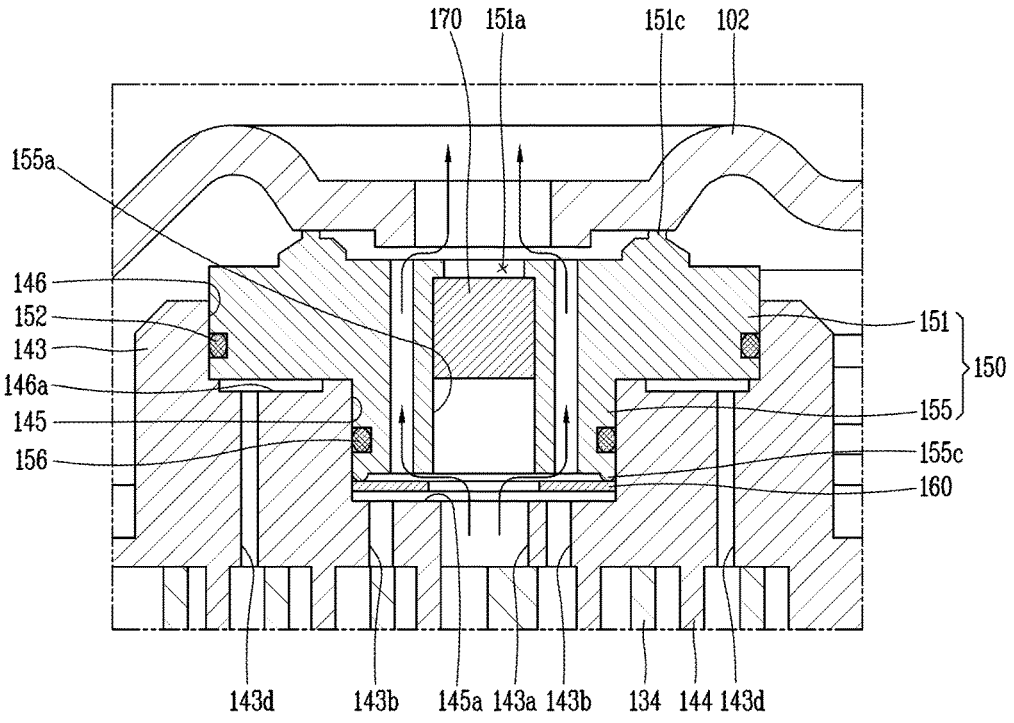
FIG. 9 is a cross-sectional view illustrating a state of a back pressure plate when the upper back pressure type scroll compressor of FIG. 3 is normally operated.

As shown in FIG. 9, if a suction pressure is increased due to a change of a drive condition, an intermediate pressure 1.5 times higher than the suction pressure becomes higher than a discharge pressure. In a case of the scroll compressor, a discharge pressure may be obtained by multiplying a suction pressure with a compression ratio, as the compression ratio may be fixed. Therefore, when the suction pressure exceeds the predetermined range, a discharge pressure is excessively increased, resulting in an overload. Thus, if a refrigerant has an excessive pressure before reaching a discharge chamber, the refrigerant should be discharged in advance, in order to solve the overload of the scroll compressor.

In this embodiment, if the intermediate pressure increases and becomes higher than the discharge pressure, the bypass valve 160 may be moved upward to open the bypass holes 143*b*. As the bypass holes 143*b* are opened, a refrigerant in the intermediate pressure chamber may be discharged to the first upper surface 145*a*, and moved to the discharge space along the discharge passage. As a result, the intermediate pressure may be prevented from increasing excessively.

In a case of a compressor, a range of a suction pressure and a discharge pressure may be predicted, as a drive condition of a system to which the compressor is applied may preset or predetermined. Based on the range of the suction pressure and the discharge pressure, a point of an intermediate pressure chamber, where pressure is excessively high, may be predicted. Bypass holes may be formed at the point to solve an overload.

In the conventional art, even if an optimum position of the bypass holes is determined, if the optimum position corresponds to outside of the hub member, it is impossible to form the bypass holes at the position. However, in this embodiment, as a hub member forms a part of the back pressure plate, bypass holes may be formed at any position of the plate portion of the non-orbital scroll, and the bypass valve may be installed. This may effectively prevent overload of the scroll compressor.

Further, in the conventional art, the back pressure plate to support the bypass valve and the check valve, and the floating plate, which forms the back pressure chamber at the back pressure plate or the hub member, are individually fabricated to be assembled to each other. This may cause an increase in the number of assembly processes, and may cause difficulty in sealing a gap between the discharge opening and the back pressure chamber due to an assembly tolerance. However, in this embodiment, as the floating plate is integrally formed with the back pressure plate or the hub member, the number of assembly processes may be reduced, and a space between the discharge opening and the back pressure chamber may be easily sealed. This may enhance performance of the scroll compressor.

Embodiments disclosed herein provide a scroll compressor capable of arranging bypass holes at any position of a non-orbital scroll. Embodiments disclosed herein further provide a scroll compressor capable of adopting a bypass valve having a simple structure. Embodiments disclosed herein additionally provide a scroll compressor capable of reducing production costs by reducing a number of assembly processes, and capable of easily sealing a gap between a back pressure chamber and a discharge opening.

Embodiments disclosed herein provide a scroll compressor that may include a casing; a discharge cover fixed to an inner space of the casing, that divides the inner space of the case into a suction space and a discharge space; a main frame arranged in the casing, and spaced from the discharge cover; an orbital scroll that performs an orbital motion in a supported state on the main frame; a non-orbital scroll coupled to the main frame so as to be movable up and down with respect to the orbital scroll, that forms a suction chamber, an intermediate pressure chamber, and a discharge chamber together with the orbital scroll; and a back pressure plate provided between the discharge cover and the non-orbital scroll, that forms a back pressure chamber that communicates with the intermediate pressure chamber. A discharge opening that communicates with the discharge chamber may be formed at the non-orbital scroll, and bypass holes may be formed at a periphery of the discharge opening. A bypass valve configured to open and close the bypass holes may be installed between the non-orbital scroll and the back pressure plate.

The bypass valve may be inserted into a valve space, that is, a space between a lower surface of the back pressure plate and an upper surface of the non-orbital scroll. The bypass valve may be formed in a ring shape, and may be inserted into the valve space in a free state.

A retainer protrusion, which may be configured to restrict an open degree of the bypass valve, may be formed at a lower surface of the back pressure plate. The bypass valve may be formed in a ring shape, and may be coupled to the non-orbital scroll.

An intermediate discharge opening that communicates with the discharge opening, and configured to guide a refrigerant discharged from the discharge opening to a discharge space, may be formed at the back pressure plate. The intermediate discharge opening may be formed at a position overlapped with the bypass valve.

A first ring-shaped wall, which may have a predetermined depth so as to accommodate therein the discharge opening and a bypass hole, may be formed at an upper surface of the non-orbital scroll. A guide portion or guide, which may constitute or form a part or portion of the back pressure plate, may be inserted to be coupled to the first ring-shaped wall. A valve guide hole, which may be configured to slidably insert or receive therein a check valve to open and close the discharge opening by a pressure difference between the discharge chamber and the discharge space, may be formed at the guide portion.

An intermediate discharge opening may be formed to pass through a lower surface of the guide portion and an upper surface of the back pressure plate. The intermediate discharge opening may be configured to guide a refrigerant discharged from the discharge opening to the discharge space.

A second ring-shaped wall, to which an outer circumferential surface of the back pressure plate may be inserted to be coupled, may be formed outside of the first ring-shaped wall. At least one back pressure hole that communicates with the intermediate pressure chamber may be formed between an outer side surface of the first ring-shaped wall and an inner side surface of the second ring-shaped wall.

A back pressure groove having a predetermined depth may be formed at a lower surface of the back pressure plate, or an upper surface of the non-orbital scroll corresponding to the lower surface of the back pressure plate. The back pressure groove may communicate with the back pressure hole.

The back pressure plate may include a guide portion or guide inserted into an inner circumferential surface of the first ring-shaped wall, and a back pressure portion inserted into an inner circumferential surface of the second ring-shaped wall. The guide portion may integrally extend from a lower surface of the back pressure portion.

Sealing members may be provided between the non-orbital scroll and the back pressure plate. The sealing members may be provided between the back pressure chamber and the suction space, and between the back pressure chamber and a lower surface of the back pressure plate.

Embodiments disclosed herein may further provide a scroll compressor that may include a casing; a discharge cover fixed to an inner space of the casing, that divides the inner space of the case into a suction space and a discharge space; a main frame arranged in the casing, and spaced from the discharge cover; an orbital scroll that performs an orbital motion in a supported state on the main frame; a non-orbital scroll coupled to the main frame so as to be movable up and down with respect to the orbital scroll, that forms a suction chamber, an intermediate pressure chamber, and a discharge chamber together with the orbital scroll, and the non-orbital scroll having a discharge opening that communicates with the discharge chamber and the discharge space. Bypass holes that communicate with the intermediate pressure chamber and the discharge space may be penetratingly formed at a periphery of the discharge opening. A bypass valve may be disposed at an upper surface of the non-orbital scroll, configured to open and close the bypass holes. A back pressure plate may be provided between the discharge cover and the non-orbital scroll, configured to form a back pressure chamber communicated with the intermediate pressure chamber, and configured to support the bypass valve. The back pressure plate may include a back pressure portion that forms a back pressure chamber between itself and an upper surface of the non-orbital scroll; and a guide portion or guide that extend from a lower surface of the back pressure portion, and configured to support the bypass valve between itself and an upper surface of the non-orbital scroll.

A first ring-shaped wall, into which the guide portion may be slidably inserted, may be formed at the non-orbital scroll. A second ring-shaped wall, into which the back pressure portion may be slidably inserted, may be formed outside of the first ring-shaped wall. A sealing member may be provided between an inner circumferential surface of the first ring-shaped wall and an outer circumferential surface of the guide portion, or between an inner circumferential surface of the second ring-shaped wall and an outer circumferential surface of the back pressure portion.

The back pressure portion may be formed in a ring shape, with a discharge pressure application hole formed at a central portion thereof. The guide portion may be formed in a cylindrical shape, with a valve guide hole that communicates with the discharge pressure application hole. The valve guide hole may be configured to accommodate therein a check valve that opens and closes the discharge opening. An intermediate discharge opening may be formed to pass through a lower surface of the guide portion and an upper surface of the back pressure portion, so as to communicate with the discharge opening.

The scroll compressor according to embodiments may have at least the following advantages.

First, the non-orbital scroll may be divided into a region of the non-orbital wrap and a region of the back pressure chamber. A bypass valve and a bypass passage may be arranged between the two parts or components. This may facilitate installation of the bypass valve. With such a configuration, assembly processes may be easily performed, and production efficiency enhanced.

Second, as a position of the bypass hole may be arbitrarily set, an overload of the scroll compressor due to a change of a drive condition may be minimized. Further, even when an overload is applied to the scroll compressor during an initial compression stage, the overload may be solved.

Third, as a hub member and a floating plate may be integrally formed with each other, a sealing degree between the back pressure chamber and the discharge opening may be enhanced. Further, as a number of processes may be reduced, production costs may be reduced.

Fourth, as a suction side compression chamber and a discharge side compression chamber may be simultaneously opened and closed with a simplified structure of the bypass valve, a pressure difference between the two compression chambers may be reduced. This may enhance performance of the scroll compressor.

Further scope of applicability of embodiments will become more apparent from the detailed description. However, it should be understood that the detailed description and specific examples, while indicating embodiments, are given by way of illustration only, as various changes and modifications within the spirit and scope will become apparent to those skilled in the art from the detailed description.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor having a back pressure device, comprising:

a casing;

a discharge cover fixed to an inner space of the casing, that divides the inner space of the case into a suction space and a discharge space;

a main frame arranged in the casing, and spaced from the discharge cover;

an orbital scroll that performs an orbital motion in a state in which the orbital scroll is supported on the main frame;

a non-orbital scroll coupled to the main frame so as to be movable in an upward and downward direction with respect to the orbital scroll, that forms a suction chamber, an intermediate pressure chamber, and a discharge chamber together with the orbital scroll; and a back pressure plate provided between the discharge cover and the non-orbital scroll, that forms a back pressure chamber that communicates with the intermediate pressure chamber, the back pressure plate having a discharge passage at a central portion thereof that communicates with the discharge space, wherein the back pressure plate includes:

a back pressure portion that forms the back pressure chamber with an upper surface of the non-orbital scroll; and a guide that extends from a lower surface of the back pressure portion, wherein a first ring-shaped wall, into which the guide is slidably inserted, is formed at the non-orbital scroll, wherein a second ring-shaped wall, into which the back pressure portion is slidably inserted, is formed outside of the first ring-shaped wall, and wherein at least one back pressure hole that communicates with the intermediate pressure chamber is formed between an outer side surface of the first ring-shaped wall and an inner side surface of the second ring-shaped wall, and wherein a discharge opening that communicates with the discharge chamber is formed in the non-orbital scroll, wherein bypass holes are formed at a periphery of the discharge opening, and wherein a bypass valve that opens and closes the bypass holes is installed between the non-orbital scroll and the back pressure plate.

2. The scroll compressor of claim 1, wherein the bypass valve is inserted into a valve space provided between a lower surface of the back pressure plate and an upper surface of the non-orbital scroll.

3. The scroll compressor of claim 2, wherein the bypass valve is formed in a ring shape, and is inserted into the valve space in a free floating state.

4. The scroll compressor of claim 3, wherein a retainer protrusion that restricts an open degree of the bypass valve is formed at a lower surface of the back pressure plate.

5. The scroll compressor of claim 2, wherein the bypass valve is formed in a ring shape, and is coupled to the non-orbital scroll.

6. The scroll compressor of claim 3, wherein at least one intermediate discharge opening, that communicates with the discharge opening and guides a refrigerant discharged from the discharge opening to the discharge space is formed at the back pressure plate, and wherein the at least one intermediate discharge opening is formed at a position overlapped with the bypass valve.

7. The scroll compressor of claim 1, wherein the discharge passage comprises a valve guide hole configured to slidably receive therein a check valve that opens and closes the discharge opening of the non-orbital scroll by a pressure difference between the discharge chamber and the discharge space is formed at the guide.

8. The scroll compressor of claim 7, wherein at least one intermediate discharge opening is formed to pass through a lower surface of the guide and an upper surface of the back pressure plate, and wherein the at least one intermediate discharge opening guides a refrigerant discharged from the discharge opening to the discharge space.

9. The scroll compressor of claim 1, wherein a back pressure groove having a predetermined depth is formed at a lower surface of the back pressure plate, or an upper surface of the non-orbital scroll corresponding to the lower surface of the back pressure plate, and wherein the back pressure groove communicates with the back pressure hole.

10. The scroll compressor of claim 1, wherein the back pressure plate includes:

the guide, which is inserted into an inner circumferential surface of the first ring-shaped wall; and the back pressure portion, which is inserted into an inner circumferential surface of the second ring-shaped wall, wherein the guide integrally extends from a lower surface of the back pressure portion.

11. The scroll compressor of claim 10, wherein sealing members are provided between the non-orbital scroll and the back pressure plate, and wherein the sealing members are provided between the back pressure chamber and the suction space, and between the back pressure chamber and a lower surface of the back pressure plate.

12. A scroll compressor having a back pressure device, comprising:

a casing;

a discharge cover fixed to an inner space of the casing, that divides the inner space of the case into a suction space and a discharge space;

a main frame arranged in the casing, and spaced from the discharge cover;

an orbital scroll that performs an orbital motion in a state in which the orbital scroll is supposed on the main frame;

a non-orbital scroll coupled to the main frame so as to be movable in an upward and downward direction with respect to the orbital scroll, that forms a suction chamber, an intermediate pressure chamber, and a discharge chamber together with the orbital scroll, and having a discharge opening that communicates with the discharge chamber and the discharge space, wherein bypass holes that communicates with the intermediate pressure chamber and the discharge space are penetratingly formed at a periphery of the discharge opening;

a bypass valve disposed at an upper surface of the non-orbital scroll, that opens and closes the bypass holes; and a back pressure plate provided between the discharge cover and the non-orbital scroll, that forms a back pressure chamber that communicates with the intermediate pressure chamber and supports the bypass valve, wherein the back pressure plate includes:

a back pressure portion that forms a back pressure chamber with an upper surface of the non-orbital scroll; and a guide that extends from a lower surface of the back pressure portion, and supports the bypass valve along with an upper surface of the non-orbital scroll, wherein a first ring-shaped wall, into which the guide is slidably inserted, is formed at the non-orbital scroll, wherein a second ring-shaped wall, into which the back pressure portion is slidably inserted, is formed outside of the first ring-shaped wall, and wherein a sealing member is provided between an inner circumferential surface of the first ring-shaped wall and an outer circumferential surface of the guide, or between an inner circumferential surface of the second ring-shaped wall and an outer circumferential surface of the back pressure portion.

13. The scroll compressor of claim 12, wherein the back pressure portion is formed in a ring shape, with a discharge pressure application hole formed at a central portion thereof, wherein the guide is formed in a cylindrical shape, with a valve guide hole that communicates with the discharge pressure application hole, wherein the valve guide hole accommodates therein a check valve that opens and closes the discharge opening, and wherein at least one intermediate discharge opening is formed to pass through a lower surface of the guide and an upper surface of the back pressure portion, so as to communicate with the discharge opening.

14. A scroll compressor having a back pressure device, comprising:

a casing;

a discharge cover fixed to an inner space of the casing, that divides the inner space of the case into a suction space and a discharge space;

a main frame arranged in the casing, and spaced from the discharge cover;

a first scroll that performs an orbital motion in a state in which the first scroll is supported on the main frame;

a second scroll coupled to the main frame so as to be movable in an upward and downward direction with respect to the first scroll, that forms a suction chamber, an intermediate pressure chamber, and a discharge chamber together with the first scroll, wherein a discharge opening that communicates with the discharge chamber is formed at a central portion of the second scroll; and a back pressure plate provided between the discharge cover and the second scroll, that forms a back pressure chamber that communicates with the intermediate pressure chamber, wherein the back pressure plate comprises a discharge passage formed at a central portion thereof that communicates with the discharge space and the discharge opening of the second scroll, wherein a first ring-shaped wall having a predetermined depth so as to accommodate therein the discharge opening and bypass holes formed at an upper surface of the second scroll, wherein a guide that forms a portion of the back pressure plate is inserted into and coupled to the first ring-shaped wall, wherein a second ring-shaped wall, to which an outer circumferential surface of the back pressure plate is inserted to be fixed thereto, is formed outside of the first ring-shaped wall, and wherein at least one back pressure hole that communicates with the intermediate pressure chamber is formed between an outer side surface of the first ring-shaped wall and an inner side surface of the second ring-shaped wall.

15. The scroll compressor of claim 14, wherein the bypass holes are formed at a periphery of the discharge opening of the second scroll, and wherein a bypass valve that opens and closes the bypass holes is installed between the second scroll and the back pressure plate.

16. The scroll compressor of claim 15, wherein the discharge passage comprises a valve guide hole configured to slidably receive therein a check valve that opens and closes the discharge opening by a pressure difference between the discharge chamber and the discharge space is formed at the guide.

17. The scroll compressor of claim 16, wherein at least one intermediate discharge opening is formed to pass through a lower surface of the guide and an upper surface of the back pressure plate, and wherein the at least one intermediate discharge opening guides a refrigerant discharged from the discharge opening to the discharge space.

18. The scroll compressor of claim 14, wherein the back pressure plate includes:

the guide, which is inserted into an inner circumferential surface of the first ring-shaped wall; and a back pressure portion inserted into an inner circumferential surface of the second ring-shaped wall, wherein the guide integrally extends from a lower surface of the back pressure portion.

* * * * *